US008242342B2

(12) United States Patent
Bettinelli

(10) Patent No.: US 8,242,342 B2
(45) Date of Patent: Aug. 14, 2012

(54) HANDS-FREE PERCUSSION INSTRUMENT AND RELATED METHODS

(76) Inventor: Ed Bettinelli, Hackensack, NJ (US)

( * ) Notice: Subject to any disclaimer, the term of this patent is extended or adjusted under 35 U.S.C. 154(b) by 0 days.

(21) Appl. No.: 12/765,239

(22) Filed: Apr. 22, 2010

(65) Prior Publication Data

US 2011/0259173 A1 Oct. 27, 2011

(51) Int. Cl.
*G10D 13/08* (2006.01)

(52) U.S. Cl. ..... 84/402; 84/322; 446/421

(58) Field of Classification Search ..... 84/402, 84/322; 446/421
See application file for complete search history.

(56) References Cited

U.S. PATENT DOCUMENTS

| | | | | | |
|---|---|---|---|---|---|
| 303,139 | A | * | 8/1884 | Farnham | 446/204 |
| 385,002 | A | * | 6/1888 | Pagan | 446/422 |
| 1,258,077 | A | * | 3/1918 | Worcester | 446/26 |
| 1,613,978 | A | * | 1/1927 | Berton | 84/402 |
| 1,744,513 | A | * | 1/1930 | Smith | 36/8.3 |
| 2,466,554 | A | * | 4/1949 | Mossey | 84/422.4 |
| 2,776,592 | A | * | 1/1957 | Di Preta | 84/322 |
| 2,811,811 | A | * | 11/1957 | Faranda | 446/26 |
| 3,499,361 | A | * | 3/1970 | Harleman | 84/402 |
| 3,592,097 | A | * | 7/1971 | Friede | 84/402 |
| 4,148,424 | A | * | 4/1979 | Fortenberry | 224/218 |
| 4,179,973 | A | * | 12/1979 | White | 84/402 |
| 4,270,433 | A | * | 6/1981 | Adamec | 84/322 |
| 4,306,485 | A | * | 12/1981 | Rudkin | 84/402 |
| 4,392,325 | A | * | 7/1983 | Woronets | 446/26 |
| 4,407,091 | A | * | 10/1983 | Moody | 446/419 |
| D291,809 | S | * | 9/1987 | Jasper | D17/20 |
| 4,982,641 | A | * | 1/1991 | Duhart | 84/329 |
| 5,044,250 | A | * | 9/1991 | Beyer | 84/422.4 |
| 5,265,514 | A | * | 11/1993 | Schertz | 84/422.4 |
| 5,535,448 | A | * | 7/1996 | Williamson et al. | 2/22 |
| 5,659,143 | A | * | 8/1997 | Isackson | 84/402 |
| 5,808,215 | A | * | 9/1998 | Kralik et al. | 84/402 |
| D413,618 | S | * | 9/1999 | Murwin | D17/22 |
| 6,109,490 | A | * | 8/2000 | Caluori | 224/220 |
| 6,112,330 | A | * | 9/2000 | Bryan | 2/160 |
| 6,118,058 | A | * | 9/2000 | Rowley | 84/320 |
| 6,316,709 | B1 | * | 11/2001 | Nanberg et al. | 84/422.4 |
| 6,392,129 | B1 | * | 5/2002 | Enhoffer et al. | 84/402 |
| 6,416,379 | B1 | * | 7/2002 | Topman | 446/204 |
| 6,669,388 | B1 | * | 12/2003 | Short | 401/8 |
| 6,834,610 | B2 | * | 12/2004 | Beaham, III | 116/200 |
| 6,905,271 | B1 | * | 6/2005 | Short | 401/8 |
| 6,938,275 | B1 | * | 9/2005 | Fried | 2/162 |
| 6,955,582 | B1 | * | 10/2005 | Forbes et al. | 446/397 |
| 7,169,994 | B1 | * | 1/2007 | Payerl | 84/402 |
| 7,435,889 | B1 | * | 10/2008 | Heidt | 84/422.4 |
| D621,290 | S | * | 8/2010 | Foxcroft | D10/119.3 |
| 7,777,111 | B1 | * | 8/2010 | North | 84/402 |

(Continued)

OTHER PUBLICATIONS

Egg Shaker Rings—Blog: Art Activities & Fun Crafts Project Ideas for Kids—Family, posted Mar. 28, 2010, viewed Oct. 10, 2011 at http://blogs.familyeducation.com/parenting/moms/allison-mcdonald/egg-shaker-rings.*

*Primary Examiner* — Elvin G Enad
*Assistant Examiner* — Robert W Horn
(74) *Attorney, Agent, or Firm* — John K. Buche; Buche & Associates, P.C.

(57) ABSTRACT

Disclosed are apparatus and related methods for producing a blend of rhythm and sound.

20 Claims, 4 Drawing Sheets

U.S. PATENT DOCUMENTS

| | | | | |
|---|---|---|---|---|
| 7,960,635 | B2 * | 6/2011 | Rice | 84/422.4 |
| 2006/0117931 | A1 * | 6/2006 | Benyahia et al. | 84/322 |
| 2007/0080791 | A1 * | 4/2007 | Klaparda | 340/407.1 |
| 2011/0061512 | A1 * | 3/2011 | Slick et al. | 84/402 |
| 2011/0259173 | A1 * | 10/2011 | Bettinelli | 84/402 |

* cited by examiner

HANDS-FREE PERCUSSION INSTRUMENT AND RELATED METHODS

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of Invention

The present invention is in the field of hands-free percussion instruments and related methods of use.

2. Background of the Invention

Percussion instruments are generally known to be used for generating rhythm and/or sounds as part of a musical composition. For instance, a drummer frequently beats a drum (via a mallet (i.e., a drum stick or any other type of stick or apparatus for suitable for striking a percussion instrument)) to produce a rhythmic beat and a tapping, thumping, or booming sound for the accompaniment of other musical sounds composing a melody. Frequently, it is desirable to have a blend of rhythm and sounds from more than one type of percussion instrument. Nevertheless, without a spare musician to play another type of percussion instrument, musical groups have previously been restricted to only one percussion instrument. Accordingly, there is a need for apparatus and related methods for producing a blend of rhythm and sounds from more than one type of percussion instrument, despite a lack of spare musicians for this purpose.

To address this need, some have suggested the following: having one musician play two separate instruments with separate hands (or separate limbs); or strapping an electronic means to the musician for producing sounds or rhythm while the musician plays a primary instrument (the sound/rhythm may be continual or keyed to the musicians movement via motion sensors) (see U.S. Pat. Nos. 4,635,516 (issued Jan. 13, 1987), 4,753,146 (issued Jun. 28, 1988), 4,920,848 (May 1, 1990), 5,058,480 (issued Oct. 22, 1991), and 7,038,575 (May 2, 2006)); or strapping an auxiliary instrument to a musician's extremities so that the auxiliary instrument produces rhythm and sound while the musician is playing a primary instrument. Playing separate instruments with separate hands (or limbs) has not adequately satisfied the identified need since some instruments (e.g., a drum) require the musician to use both hands and a foot during musical operation, and using multiple limbs to play separate instruments is complicated, requires a high level of body-coordination, and countless hours of training. Producing sound via electronic equipment has also not sufficiently addressed the above-identified need since electronic equipment is expensive, frequently does not produce an authentic sound or rhythm, and cannot dynamically adapt as would a live musician when presented with circumstances requiring an on-the-fly alteration of the sound or rhythm. Finally, strapping an auxiliary instrument to a musician's extremities so that the auxiliary instrument produces rhythm and sounds while the musician is playing a primary instrument has not fully addressed the above identified need since, among other reasons, the auxiliary instrument and the primary instruments may require conflicting motions from the musician's body (i.e., conflicting modes of instrument operation), and awkward or clumsy movements. Consider the following examples: U.S. Pat. No. 2,242,912 (issued May 20, 1941) discloses a flute worn on the wrist or finger, but when played with a primary percussion instrument, the user must hold the hand or wrist to a mouth which movement/positioning is typically in conflict with preferable modes of operation for the percussion instrument (e.g., shaking or swinging of the arm) (see also U.S. Pat. Nos. D128,297 (issued Jul. 15, 1941), D182,490 (issued Apr. 8, 1958), 2,780,954 (issued Feb. 12, 1957)); and U.S. Pat. No. 3,499,361 (issued Mar. 10, 1970) discloses clappers attached to opposing fingers whereby the fingers may be brought together to produce a clapping sound, but when played with a primary percussion instrument, a musician may not be able to fully or properly grip the percussion instruments while clapping the auxiliary instrument via opposing fingers. Thus, there is a need for apparatus and related methods for producing a blend of rhythm and sounds from more than one type of percussion instrument despite a lack of spare musicians for this purpose and in a manner that does not require high-levels of body-coordination, countless hours of training, expensive electronic equipment, or conflicting body motions/modes of instrument operation.

One attempt to satisfy the identified needs is the Go-Jo Bag by Latin Percussion. www.lpmusic.com/Product_Showcase/Shakers/lp_gojo_bag.html. The Go-Jo Bag is a bean bag with a strap that produces sounds and/or rhythm via (a) strapping the bag to a palm and repeatedly closing the hand (also works by tossing the bag in the air), (b) grabbing the strap and shaking the bean bag in the manner of maracas or shakers, (c) sliding the bean bag in a manner of an afuche or cabasas, (d) striking the bean bags together, or (b) strapping the bag to a palm and striking other objects (e.g., congas) with the open palm. Id. Many of the modes of Go-Jo Bag operation have the drawbacks mentioned above, namely, if played with a primary instrument, the Go-Jo Bag requires a high-level of coordination, lots of extra training, or conflicting movements/modes of operation. Further, when a Go-Jo Bag is strapped to the palm or wrist of a musician, not all types of percussion instruments can be played as a primary instrument. For example, mallet-stricken percussion instruments cannot properly be played in conjunction with the Go-Jo Bag by a single musician because either the palm is obstructed by the bag (or strap) whereby the musician cannot adequately grab the mallet or the wrist is impeded whereby the musician cannot adequately twist or snap the wrist as required during mallet striking. Accordingly, there a need for apparatus and related methods for producing a blend of rhythm and sounds from more than one type of percussion instrument and in a manner that does not require high-levels of body-coordination, countless hours of training, expensive electronic equipment, conflicting body motions/modes of instrument operation, and without impeding the operation of a mallet-stricken percussion instruments.

While believed inadequate for the currently disclosed purposes, apparatus are known to be attached to a hand for various purposes without fully limiting the gripping function of the hand. Namely, U.S. Pat. No. 2,258,96 (issued Dec. 24, 1940) discloses a thumb guard worn over the entire thumb and around the wrist; U.S. Pat. No. 2,633,126 (issued Mar. 31, 1953) discloses an anti-thumb sucking device worn over the entire thumb and around the wrist; U.S. Pat. No. D310,764 (issued Sep. 18, 1990) discloses a thumb protector worn around the thumb and partial palm; U.S. Pat. No. 5,797,405 (issued Aug. 25, 1998) discloses a thumb-sucking deterrent device worn over the entire thumb, most of the palm, and around the wrist; U.S. Pat. No. D416,650 (issued Nov. 16, 1999) discloses a child's thumb guard worn over the entire thumb, part of the palm, and around the wrist; and U.S. Pat. No. 6,101,628 (issued Aug. 15, 2006) discloses a thumb protection device worn over the entire thumb, part of the palm, and around the wrist (see FIG. 5). Such apparatus, although designed for attachment to a hand without fully limiting the gripping function of the hand, are not adequate or adapted to the purpose of securing an auxiliary musical instrument to a hand in a manner that overcomes the disadvantages identified above. More specifically, and among other reasons, the disclosed apparatus hinder at least the range of motion of the thumb-knuckles and wrist whereby a mallet stricken percussion instrument cannot be played in a preferable manner. As a result, such apparatus cannot be consulted for input towards a solution to the above needs.

SUMMARY OF THE INVENTION

It is an object of the present application to disclose apparatus for satisfying the above-identified needs without the identified inadequacies of the known art. In one non-limiting embodiment, a preferred apparatus is a percussion musical instrument which is secured to the back/or side of the hand (or foot) via a securing means interacting between the knuckles of a musician's finger, e.g., the thumb. Further, the preferred apparatus may feature a body with one or more hollow portions with a fill material therein disposed so movement of the fill material causes interaction between the fill material and itself or the sides of the hollow portions to produce sounds or rhythms. Yet still, the securing means of a preferred embodiment may be a strap positionable between the knuckles of a finger whereby the strap does not impede the full range of knuckle motion.

Yet another object of the present application is to disclose methods for satisfying the above-identified needs without the identified inadequacies of the known art. In one non-limiting embodiment, a preferred method is a method for producing a blend of sound and rhythm comprising the steps of: strapping a first percussion musical instrument to the hand of a musician in between two knuckles of the same finger whereby the finger's range of motion is not limited; gripping a mallet (i.e., any stick, apparatus, or device suitable for striking a percussion instrument) with the hand; striking a second percussion musical instrument with the mallet via the hand in a striking-manner that is preferable for the operation of the second percussion instrument; and, wherein both musical instruments produce a sound.

It is yet still a further objective to meet these needs in an efficient and inexpensive manner.

BRIEF DESCRIPTION OF THE FIGURES

The manner in which these objectives and other desirable characteristics can be obtained is better explained in the following description and attached figures in which.

It is to be noted, however, that the appended figures illustrate only typical embodiments disclosed in this application, and therefore, are not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

In general, a preferred embodiment of the present application may be a percussion instrument 1 which may be operated by a musician who is contemporaneously operating another primary percussion instrument. Suitably, the disclosed instrument 1 may be received on the back or side of the musician's hand, and secured thereto via a securing means disposed in between two knuckles of a single finger. Operably, the instrument 1, when worn and without more, produces sounds or rhythm during the ordinary course of a musician's operation of a primary instrument. The more specific details and aspects of the disclosed embodiment are further described below with reference to the figures.

Figure 1:
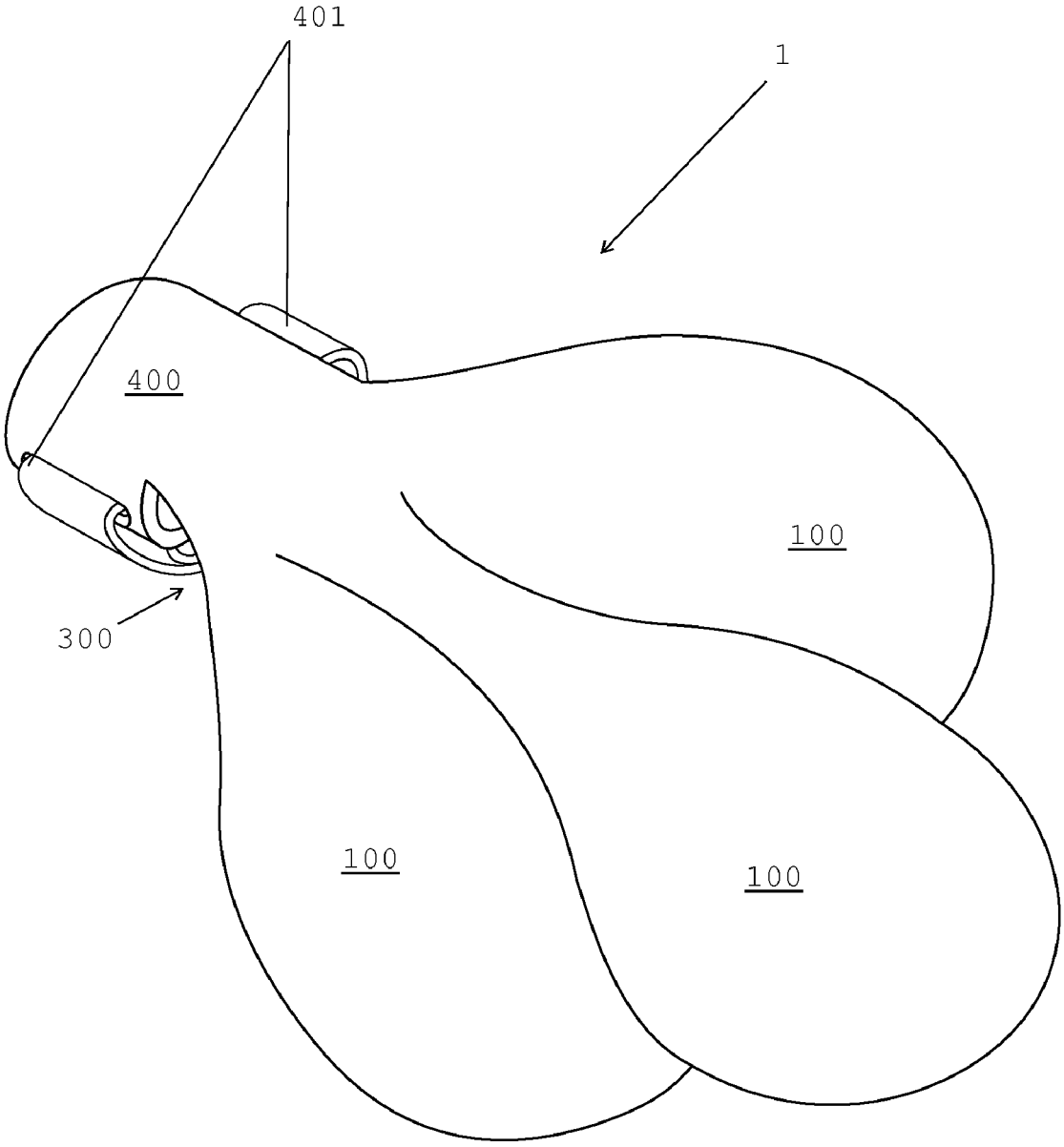
FIG. 1 is a perspective view of a percussion instrument 1 preferably embodying this application.
Figure 2:
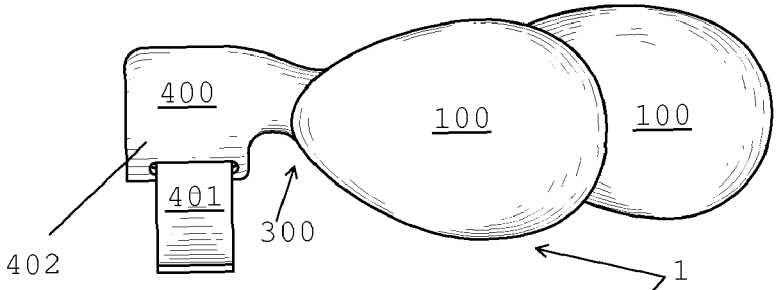
FIG. 2 is an orthogonal left-side view of the instrument of FIG. 1.
Figure 3:
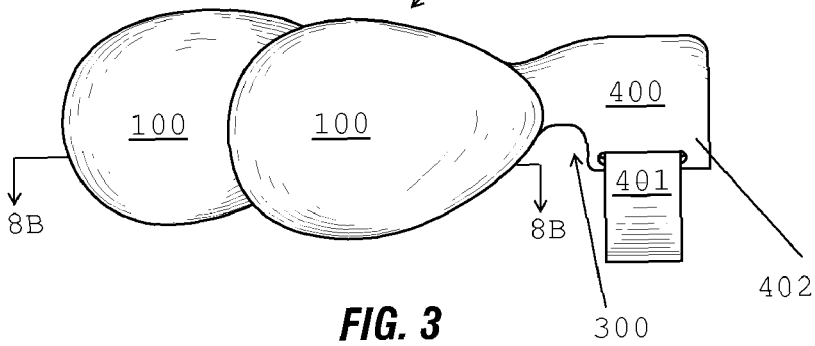
FIG. 3 is an orthogonal right-side view of the instrument of FIG. 1.

FIG. 1 is a perspective view of a preferable instrument 1. As seen in the figure, the instrument 1 may comprise: at least one hollow portion 100; at least one hand receptacle 300; and, at least one means 400 for securing the instrument to a hand received in the hand receptacle 300. As discussed below in connection with the later figures, the instrument 1 further comprises a fill material 200 disposed within the hollow portion(s) 100 of the instrument 1 so that interaction of the fill material 200 with the hollow portion(s) 100 produces sounds or rhythm.

FIGS. 2 through 7 depict the six orthogonal views of the instrument 1 depicted in FIG. 1. More specifically, FIGS. 2 through 7 respectively depict the front, rear, right-side, left-side, top, and bottom views of the instrument 1 depicted in FIG. 1. FIGS. 8 and 8B are respectively vertical (FIG. 5 along the line 8 of FIG. 6) and horizontal (FIG. 6 or 7 along the line 8B of FIG. 3) cross sections of the instrument. Taken together, FIGS. 1 through 8 suitably illustrate the above referenced components of the depicted instrument 1.

The hollow portion(s) 100 is best illustrated in FIGS. 1 and 8. Referring to these figures, the hollow portion(s) 100 is typically any structure with an enclosed cavity 101 therein. Suitably, the desired sound and/or the look of the instrument 1 will dictate the overall shapes and dimensions of the hollow portion(s) 100. However, a preferable shape is asymmetrical and/or ovular. Similarly, the desired sound or rhythm produced by the instrument 1 will suitably be, at least partially, affected by the materials used for constructing the hollow portion(s) 100. A preferable material is any plastic or plasticizable material, including but not limited to thermal plastics, e.g., polyethylene, polyporpylene. Further, other suitable materials are known to those of skill in the art and may include, without being limited to, woods, metals, ceramics, glasses, composites, and the like. Finally, on the outside of the hollow portion(s) 100 designs, advertisements, logos, or the like may suitably be placed/depicted thereon without departing from the spirit of the disclosure.

The fill material 200 is best seen in FIG. 8. Suitably, the fill material is disposed with the hollow portion(s) 100 (i.e., in its cavity(ies) 101) and is configured wherein movement of the fill material 200 produces interactions between itself and the walls of the hollow portion(s) 100 to produce sound. As with the composition of the hollow portion(s) 100, the desired sound or rhythm produced by the instrument 1 will suitably be, at least partially, affected by the materials used for constructing the fill material 200. Such appropriate materials include, but are not limited to, steel shot, stones, plastic particularly extruded plastic, rice, bee-bees, non-toxic materials, glass beads, or any combinations thereof. A preferable fill material 200 may be steel shot or one hundred percent steel shot in the volume of twelve and a half milliliters per cavity 101. Another preferable fill material 200 may be glass beads in the volume of twelve and a half milliliters per cavity 101. Those of skill in the art will know well the types of materials which are suitable for use as a fill material 200.

Referring to FIGS. 8 and 8B, the fill material 200 is preferably disposed within the hollow(s) without filling the entirety of the hollow cavity(ies) 101 whereby there is space for movement of the fill material 200 and whereby the fill material 200 interacts with itself and the sides of the hollow portion(s) 100 so that sound or rhythm may be produced thereby. As discussed above, the hollow cavity(ies) 101 may be ovular whereby fill material 200 may interact with itself and the hollow 100 walls in a swirling motion to produce a consistent rhythm/sound. The manner by which the fill material 200 may be deposited to within the hollow cavity(ies) 101 will be known by one of skill in the art but a few preferable manners are disclosed by U.S. Pat. Nos. 6,392,129 (issued May 21, 2002) and 5,323,678 (issued Jun. 28, 1994). Other preferable manners of depositing the fill material 200 into the cavity(ies) 101 will be understood by those of skill in the art after reading this disclosure.

Figure 4:
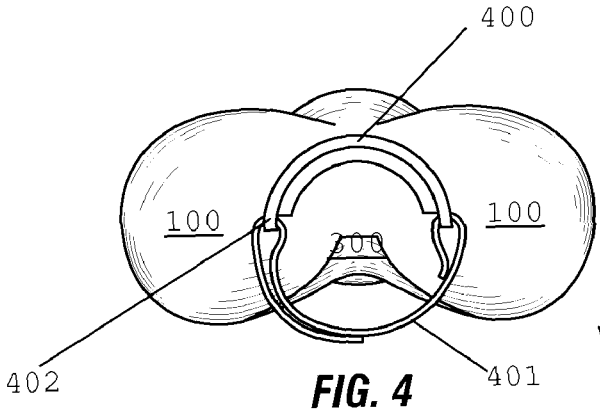
FIG. 4 is an orthogonal right-side view of the instrument of FIG. 1.
Figure 5:
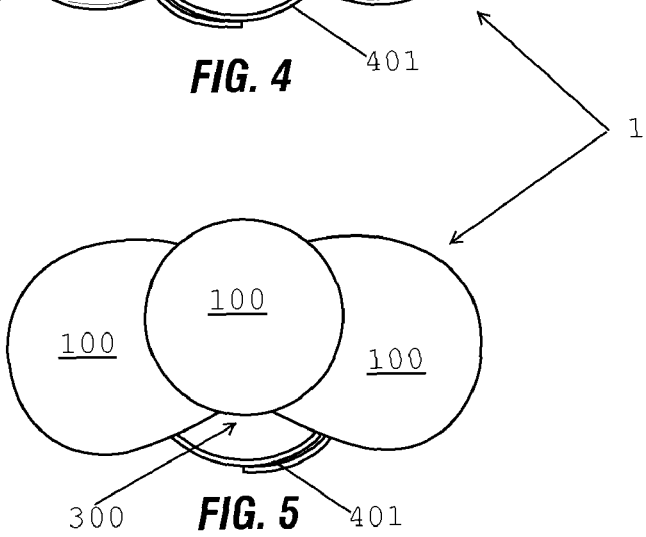
FIG. 5 is an orthogonal front view of the instrument of FIG. 1.
Figure 6:
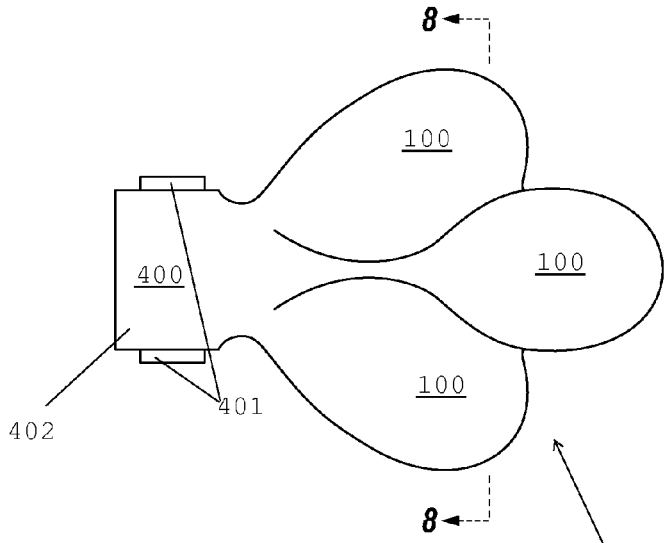
FIG. 6 is an orthogonal top view of the instrument of FIG. 1
Figure 7:
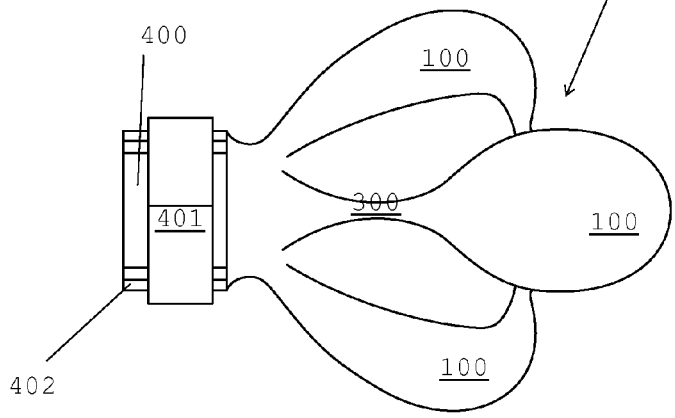
FIG. 7 is an orthogonal bottom view of the instrument of FIG. 1
Figure 8:
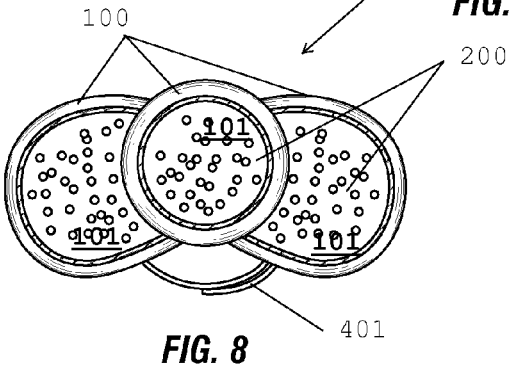
FIG. 8 is a cross section of FIG. 5 along the line 8 of FIG. 6.
Figure 8B:
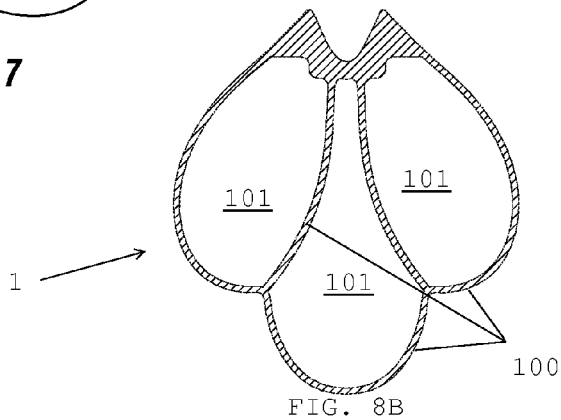
FIG. 8B is a cross section of FIG. 6 or 7 along the line 8B of FIG. 3

The hand receptacle 300 is best depicted in FIGS. 4 and 7. The hand-receptacle 300 preferably defines a surface beneath the hollow portion(s) 100 configured to receive a portion of the back or side of a human hand. In the preferable embodiment depicted by the figures, the hand receptacle 300 defines a surface configured to receive the joint of the first metacarpal and the proximal phalanx (i.e., the thumb knuckle). Importantly, the hand receptacle 300 is configured to interface with the thumb knuckle surface, but is not secured thereto so that the range of motion of the thumb knuckle is not impeded. Positioning of the instrument 1 over the thumb knuckle is preferable since, in that position, its 1 weight is not supported by the finger whereby it 1 will not interfere with the ordinary operation of the hand and is therefore "hands-free." Stated differently, the instrument 1 is suitably not weight barring to a wearer's thumb when positioned over the thumb knuckle as directed above. Other preferable configurations of the hand receptacle 300 may become apparent to one of skill in the art after reading this disclosure.

The means 400 for securing the instrument 1 to a hand received in the hand receptacle 300 is best illustrated in FIGS. 4 and 7. As can be seen in the recited figures, the means 400 is preferably a saddle 402 and strap 401 or cinch that fits around the hand's proximal phalanx whereby the range of motion for the joints on either end the phalanx is not impeded. Further, the saddle 402 and cinch 401 are preferably the only connection the instrument 1 has to the hand. The adjustable strap 401 or cinch may suitably be fitted with hook and loop fasteners (e.g., Velcro) whereby the instrument 1 may be used by musicians having a proximal phalanx of varying girth. In other words, the saddle 402 and cinch 401 create a one-size-fits-all universal fitting. However, a customized instrument 1 wherein the securing means 400 is a ring that is pre-fit to the size of a wearer's thumb may be the employed without departing from the intent of this disclosure. Other methods or means 400 for securing the instrument 1 to a hand received within the receptacle 300 will become readily apparent to one of skill in the art after reading this disclosure.

It should be noted that the dimensions of the instrument 1 may vary to accommodate musicians of varying sizes or to produce different sounds/rhythms. Subject thereto, an instrument may preferably be dimensioned with a length equal to 4.719 inches, a width equal to 3.355 inches, a height equal to 1.865 inches, and chamber cavity 101 wall thickness of 0.059 inches.

Figure 9:
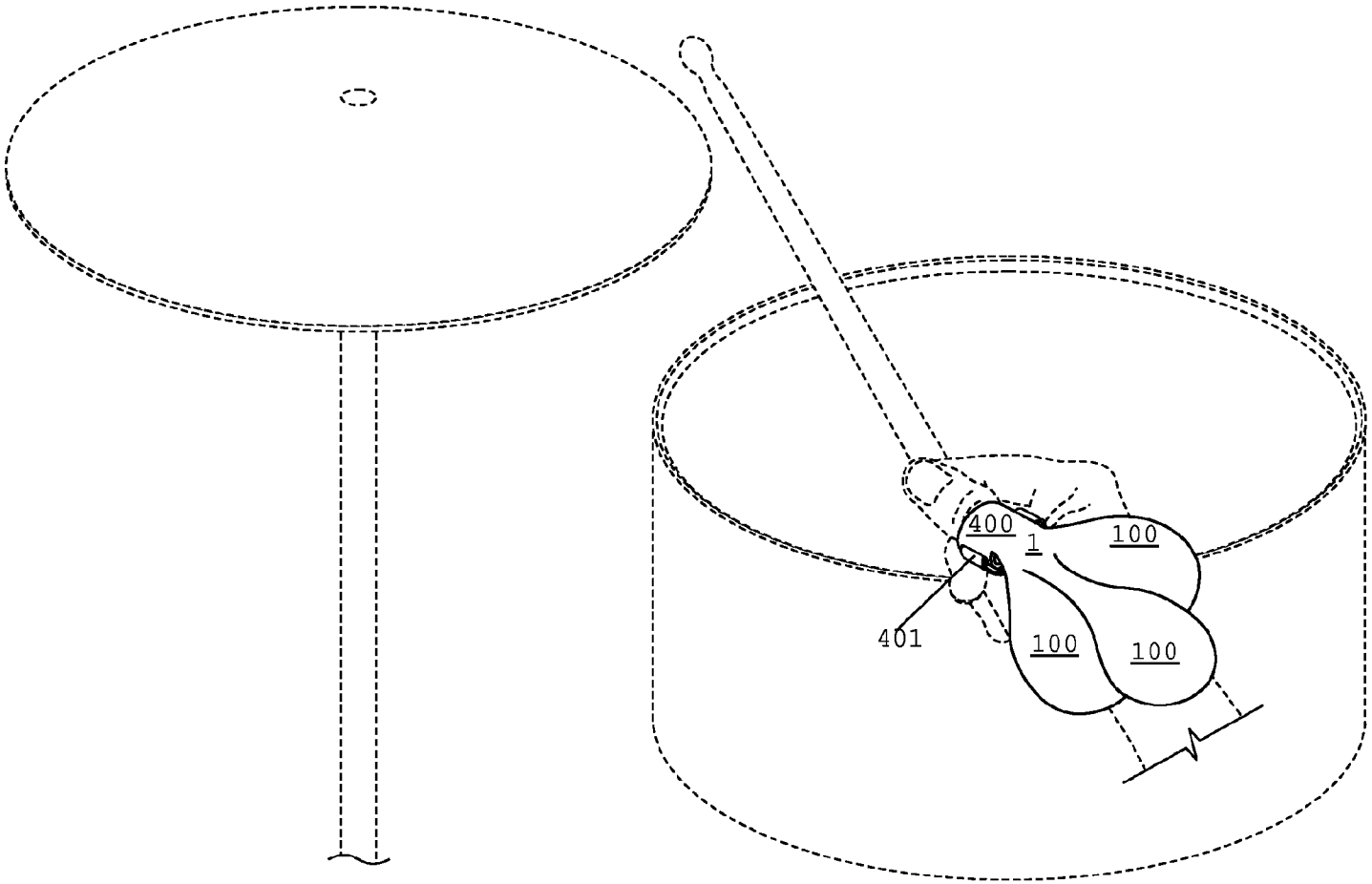
FIG. 9 is a contextual view of the instrument 1 of FIGS. 1 through 8.

FIG. 9 is a contextual view of the instrument 1. As depicted in the figure, the instrument 1 of the earlier figures is adapted to be placed on a musician's thumb-knuckle at the receptacle 300 and secured to the musician's hand at the proximal phalanx via the securing means 400. In operation, a musician wearing an instrument 1 may operate a primary instrument (e.g., a drum) according to the ordinary mode of operation, yet produce auxiliary sounds via the instrument 1. More specifically, motion of the musician's hands, made during the course of operating a primary instrument, induces movement of the fill material 200 within the hollow portion(s) 100 whereby interaction between the fill material 200 and itself or the hollow portion(s) 100 wall may produce rhythm or sound. If additional movements which may induce movement of the fill material 200 are capable of being made without departing from the preferable manner of operating the primary instrument, it is contemplated by this application that the musician further employs such movements during the operation of the primary instrument. Operably, therefore, a desirable blend of percussive sounds and/or rhythms may be accomplished, according to one exemplary method, by performing the steps of: strapping a first percussion musical instrument 1 to the hand of a musician in between two knuckles of the same finger whereby the finger's range of motion is not limited; gripping a mallet with the hand; striking a second percussion musical instrument with the mallet via the hand in a striking-manner that is preferable for the operation of the second percussion instrument; and, wherein both musical instruments produce sound.

In summary, the application may disclose a percussion instrument that may be attached to the proximal phalanx of a musician's thumb (or of any other of the musician's digits) while having the bulk and weight of the instrument centered above the musician's metacarpophalangeal joint (preferably without any attachment to that region). Suitably, such manner of attachment to, and placement on, the musician's hand preserves the freedom of movement in the metacarpophalangeal and interphalangeal joints (i.e., the knuckles of the digit) without a loss of dexterity so that the instrument may be worn while the musician is playing a primary instrument according to its ordinary manner of operation. It should be noted that FIGS. 1 through 9 and the associated description are of illustrative importance only. In other words, the depiction and descriptions of the present invention should not be construed as limiting of the subject matter in this application. Additional modifications may become apparent to one skilled in the art after reading this disclosure.

I claim:

1. A percussion musical instrument comprising:

at least one hollow portion defining a cavity;

a fill material disposed within the cavity of the hollow;

a receptacle that is configured to interface with a thumb knuckle; and, means for securing the hollow to a hand at a location between two knuckles of the same digit, wherein said digit is a thumb.

2. The instrument of claim 1 wherein the hand receptacle is adapted to be unobstructively received atop the thumb-knuckle, whereby the user may simultaneously play a second instrument.

3. The instrument of claim 1 wherein the fill material is selected from the group consisting essentially of steel shot, stones, plastic, rice, or bee-bees.

4. The instrument of claim 1 wherein the cavity is asymmetrical.

5. The instrument of claim 4 wherein the cavity is partially filled with the fill material.

6. The instrument of claim 1 wherein the hollow is constructed out of a material selected from the group consisting essentially of plastic, wood, glass, ceramic, metal, composite, polyethylene, polypropylene.

7. The instrument of claim 1 wherein the hollow is constructed of polyethylene or polypropylene.

8. A method of producing a blend of sound and rhythm comprising the steps of:

strapping a first percussion musical instrument to at least one hand of a musician in between two knuckles of the same finger whereby the finger's range of motion is unhindered;

supporting the weight of the first percussion musical instrument on the thumb knuckle of said hand; but where the thumb's range of motion is generally unhindered by the first percussion musical instrument;

gripping a mallet with the hand;

striking a second percussion musical instrument with the mallet via the same hand in a striking manner; and, wherein the first and second musical instruments produce sound.

9. The method of claim 8 further comprising the step of moving the mallet via the hand in a manner that does not produce sound by the second instrument but nevertheless produces a sound in the first instrument.

10. The method of claim 9 further comprising the step of positioning the thumb knuckle into a hand receptacle of the first percussion musical instrument.

11. The method of claim 8 wherein the first musical instrument comprises:

a hollow defining a cavity;

a fill material disposed within the cavity of the hollow; and, means for securing the cavity to a hand at a location between two knuckles of the same finger.

12. The method of claim 11 wherein the first instrument further comprises a hand receptacle that is configured to interface with a thumb knuckle and be placed over the thumb.

13. The method of claim 9 wherein the hand receptacle is adapted to be unobstructingly received on a thumb-knuckle.

14. The method of claim 11 wherein the fill material is selected from the group consisting essentially of steel shot, stones, plastic particularly extruded plastic, rice, or bee-bees.

15. The method of claim 11 wherein the cavity is asymmetrical.

16. The method of claim 11 wherein the cavity is partially filled with the fill material.

17. The method of claim 9 wherein the hollow is constructed out of a material selected from the group consisting essentially of plastic, wood, glass, ceramic, metal, polyethylene, polypropylene, or composite.

18. The method of claim 11 wherein the hollow is constructed of polyethylene.

19. A musical instrument comprising:

at least one cavity;

a fill material disposed within the cavity(ies);

a hand receptacle that is configured to interface with a thumb knuckle when positioned over the thumb knuckle; and, at least one means for securing the cavity(ies) to a hand at a location between two knuckles of the same finger, said finger being a thumb.

20. A method of producing a blend of sound and rhythm comprising the steps of:

strapping a first percussion musical instrument to at least one hand of a musician in between two knuckles of the same finger whereby the finger's range of motion is preserved;

playing a second musical instrument via moving the same hand in a forward direction; and, wherein the first and second musical instruments produce sound.

* * * * *